United States Patent [19]

Craven

[11] 4,072,847

[45] Feb. 7, 1978

[54] ELECTRICAL HEATER FOR HEATING LIQUID

[75] Inventor: John Leslie Craven, Leigh-on-Sea, England

[73] Assignee: Liquifry Company Limited, England

[21] Appl. No.: 751,339

[22] Filed: Dec. 16, 1976

[30] Foreign Application Priority Data

Dec. 16, 1975 United Kingdom ..... 51509/75

[51] Int. Cl.[2] ..... H05B 3/80; H01C 1/02

[52] U.S. Cl. ..... 219/523; 219/331; 219/335; 219/534; 219/544; 338/229; 338/302

[58] Field of Search ..... 219/316, 318, 328, 331, 219/332, 335, 512, 523, 534, 542, 544; 338/229, 302

[56] References Cited

U.S. PATENT DOCUMENTS

| | | | |
|---|---|---|---|
| 2,766,367 | 10/1956 | Chaustowich | 219/523 |
| 3,107,290 | 10/1963 | Willinger | 219/523 X |
| 3,329,803 | 7/1967 | Sink | 219/523 X |
| 3,340,382 | 9/1967 | Lennox | 219/544 |
| 3,371,192 | 2/1968 | Rosenel | 219/523 |
| 3,619,565 | 11/1971 | D'Elia et al. | 219/523 |
| 3,731,058 | 5/1973 | Bleiweiss | 219/523 |
| 3,895,217 | 7/1975 | Hall et al. | 219/523 |

FOREIGN PATENT DOCUMENTS

| | | | |
|---|---|---|---|
| 595,969 | 12/1947 | United Kingdom | 219/523 |
| 1,197,330 | 7/1970 | United Kingdom | 219/523 |
| 1,373,093 | 11/1974 | United Kingdom | 219/523 |

*Primary Examiner*—Volodymyr Y. Mayewsky
*Attorney, Agent, or Firm*—Browdy and Neimark

[57] ABSTRACT

An electrical heater comprises a sealed glass tube containing a sealed tubular structure formed by, (a) a metal tube containing an electrical heating element insulated from the metal tube, and (b) a plastics tube sealed to one end of the metal tube and containing a thermostat for the heating element.

7 Claims, 2 Drawing Figures

ELECTRICAL HEATER FOR HEATING LIQUID

BACKGROUND TO THE INVENTION

The present invention relates to an electrical heater having a heating element and a temperature-sensitive device for controlling the operating temperature of the element as a function of ambient temperature.

In most major countries, stringent regulations have been introduced with regard to safety requirements relating to the insulation and strength of electrical water heaters. Most designs of heater which have heretofore been satisfactory do not meet these requirements.

SUMMARY OF THE INVENTION

According to the invention, there is provided an electrical heater for heating a liquid, the heater having a heating element and a temperature-sensitive device for controlling the operating temperature of the element as a function of ambient temperature, the invention being characterized by a tubular enclosure sealed against ingress of moisture and formed by a metal tube closed at one end and an electrically insulative plastics tube joined in water-tight manner to the other end of the metal tube, the heating element being within and electrically insulated from the metal tube and the temperature-sensitive device being within the plastics tube. The metal tube provides a strong housing for the heating element and can easily be designed to withstand strength tests, such as an impact test. At the same time it is possible to provide adequate insulation between the heating element and the metal portion to meet electrical insulation requirements, such as the double insulation requirement of the British Standards Institute.

The plastics tube can be made of such a material (e.g. a polycarbonate) and of such wall thickness (e.g. 2mm or more) as to withstand strength tests and provide insulation for the temperature-sensitive device it contains. With sufficient wall thickness and with the electrical elements within the plastics tube held spaced from the wall, one can meet rigorous electrical insulation requirements.

Preferably the tubular structure is housed in a glass tube sealed against ingress of water to prevent corrosion; the fragility of this glass tube does not detract from the overall strength of the heater as full protection can be provided by the inner, water-tight, metal and plastics tubes in the event of glass breakage.

Preferably the heating element and temperature-sensitive device are in compartments or zones of the metal and plastics tubes separated by heat-insulative material so that the effect of ambient conditions on the temperature-sensitive device override the effect of the heating element on the temperature-sensitive device.

A preferred embodiment of the heater comprises the tubular structure formed by the metal tube closed at one end and the plastics tube joined in water-tight manner to the other end of the metal portion; a tube of electrically insulative material within the metal tube; the electrical heating element the conductors of which are arranged within said tube of insulative material and are spaced from that tube by insulating material (e.g. air or sand); the temperature-sensitive device is contained within the plastics tubular portion and separated from the heating element by a heat-insulative material; and sealing means sealing that end of the plastics portion remote from the metal portion against ingress of water, the sealing means being so arranged as to be irremovable from the plastics portion without the use of a tool. Advantageously, the compartment or zone containing the temperature-sensitive device is wholly within the plastics portion to reduce heat transfer from the heating element.

BRIEF DESCRIPTION OF THE DRAWINGS

For a better understanding of the invention, and to show how the same may be carried into effect, reference will now be made, by way of example to the accompanying drawings, in which.

DETAILED DESCRIPTION OF EMBODIMENTS

The figures show immersion heaters which are intended to be at least partially immersed in liquid during use.

Figure 1:
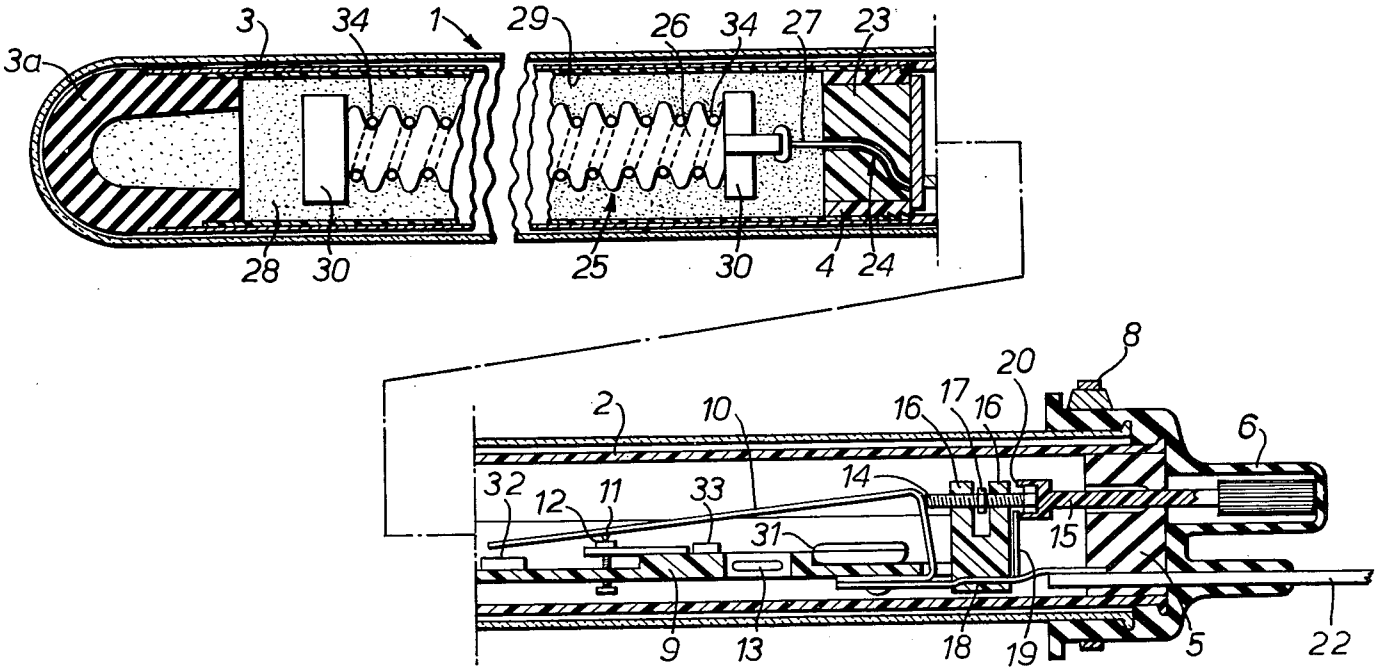
FIG. 1 shows diagrammatically, and not to scale, a section through a heater in accordance with the invention.

Referring to FIG. 1, the illustrated immersion heater comprises an outer glass tube 1 closed at its left-hand end and sealed against the entry of water at its other end by a flexible rubber end cap 6 held to the tube 1 by a tie 8. The glass tube houses a tubular structure comprising a plastics tube 2 and a metal tube 3. The metal tube 3 is closed at its left-hand end by a silicone rubber bung **3*a*** secured in place by silicone rubber adhesive. The interior of the bung is packed with heat-insulative material such as Triton.

In an alternative, that end of the tube 3 could be closed by an integral portion of the metal tube. The metal tube 3 is an alloy impact extrusion. The plastics tube 2 is preferably of polycarbonate (nylon) with a wall thickness of at least 2mm. The tube 2 has a reduced portion 4 having saw-tooth grooves and which extends into the open end of the tube 3. Silicone rubber adhesive applied to the reduced portion 4 secures the two tubes 2 and 3 together and also seals the joint against the entry of water.

A variation upon the saw-tooth grooves is a bayonet type fitting, consisting of two grooves moulded into the polycarbonate tube and two dimples formed in the aluminium tube. These dimples correspond with the grooves, so that the tubes are locked in position by pushing axially so that the length is correct and then twisting to force the dimples into a radial portion of the grooves.

Another variation is the moulding of three small dimples in the polycarbonate tube, and the pressing out of three dimples in the aluminium tube to correspond with those in the polycarbonate tube when the aluminium tube has been placed in position. This system has the advantage of providing a very strong mechanical bond which it is difficult to break without the use of a tool.

The open, right-hand end of the tube 2 is sealed against water by a rubber bung 5. The flexible rubber end cap 6 extends over the bung 5 and the glass tube 1 and is firmly held against the glass tube 1 by the tie 8 which is of such a kind and is so arranged that it cannot be removed without the use of a tool, e.g. without cutting it with a knife. The tie can therefore be, for example, of the kind employing a ratchet to oppose release.

As the cap 6 is flexible, the arrangement allows replacement of the glass tube, for example in case it breaks, whilst the glass tube prevents corrosion of the metal tube 3. Even in the event of glass breakage, the heater is still a water-tight operative assembly of adequate strength and with good electrical properties.

Contained within the plastics tubular portion 2 is an adjustable temperature sensitive switch or thermostat. The thermostat comprises an electrically insulative base 9 carrying: a bimetal strip 10 having a contact 11; a further contact 12; a neon 13; a magnet 32; a resistor 33; and an adjusting member 14. These parts are interconnected by circuitry not shown in FIG. 1 for clarity.

The adjusting member 14 is a metal screw-threaded member which abuts the bimetal strip and has a head engaged by a nylon member 15 which extends through the bung in sealing engagement therewith and into the end cap 6. The metal member 14 passes through holes in two posts 16 upstanding from the base 9 and engages with a nut 17 positioned between the posts. The nylon member is knurled at its outer end. The thermostat is adjusted by gripping the nylon member through the cap 6 and twisting the cap. In order to facilitate adjustment a scale or marking (not shown) may be provided on the nylon member to help a user judge how far the member 13 is turned. As the tube 2 is transparent, the marking is visible to the user. A metal strip 18 holds the bung 5 relative to the base 9 and has a bentup portion 19 which acts with a stop 20 to limit rotation of members 14 and 15.

A mains cord 22 extends through the cap 6 and through the bung 5 in sealing engagement with both. The cord has only two conductive wires. An earth conductor is not provided. Within the tube 2, electrical leads are provided with electrically insulative plastics sleeves in addition to their usual insulative covering. These leads are omitted from FIG. 1 for clarity.

The end of the plastics tube 2 adjacent the metal tube 3 is closed by a thermally insulative wad 23 of for instance "TRITON" (which is a Registered Trade Mark). Insulated electrical conductors 24 extend through the wad to an electrical heating element 25 arranged within the metal portion 3. The "TRITON" wad 23 is provided to protect the thermostat from heat reaching it directly from the heating element 25. It should be noted that the wad 23 defines a thermostat compartment which is wholly within the plastics tube.

The heating element comprises a cylindrical ceramic, spirally grooved, former 26 on which resistance wire 34 is wound. Leads 27 which may be of nickel tape for instance connect the resistance wire to the leads 24.

The heating element 25 is embedded in mineral electrical insulation 28 such as sand or magnesium oxide. The mineral insulation 28 is contained within an electrically insulative tube 29 of for instance "FILOMIC" which engages about the bung 3*a* and the reduced portion 4 of the plastics tube 2.

Flanges 30 on the former 26 hold the resistance wire away from the tube 29 and so the resulting air gap provides a second level of electrical insulation for the heating element. However, as in the illustrated embodiment, particulate mineral insulation 28 is provided to improve the electrical insulation and promote heat transfer to the environment.

The heater may also include in its circuit a mercury switch 31 of a kind which is conductive only when the heater is at an angle, e.g. an angle of at least 15°, to the horizontal. This provides some protection against misuse out of water, when the heater would normally be substantially horizontal on a table or other surface and might then burn that surface if it were energised.

Figure 2:
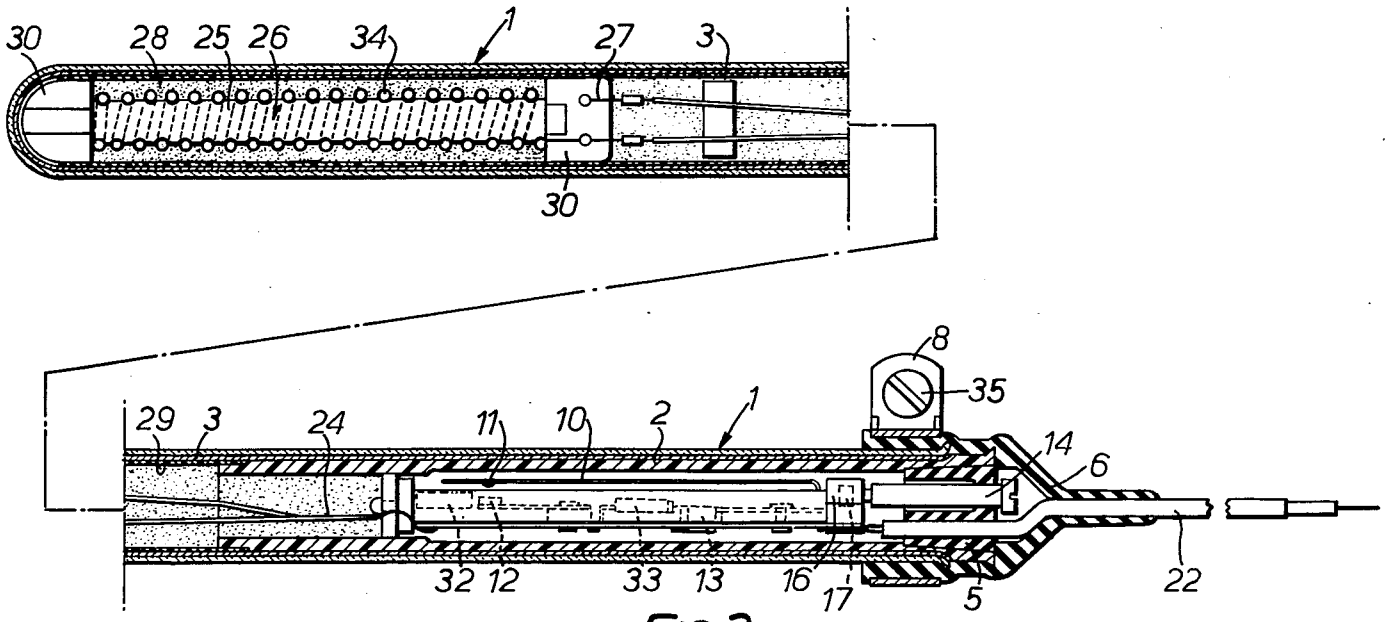
FIG. 2 shows in section details of an alternative arrangement of the heating element.

FIG. 2 is a cross-section of a similar immersion heater with a preset thermostat and with a smaller outer diameter than the heater of FIG. 1. Like parts have been given the same references.

The adjusting member 14 in this embodiment extends through the bung 5 but is not extended into a tubular projection of the cap 6, which is therefore of simpler form. The tie 8 is of the ratchet type, in this case operated by a screw 35. The insulation 23 is provided by a pre-formed disc of insulating material in place of the wad of FIG. 1. In addition, the metal tube 3 has an integral closure at its lefthand end.

I claim:

1. An electrical heater for heating a liquid, the heater comprising: a pair of conductors for applying electrical energy to the heater; an electrical heating element coupled across said conductors; a temperature-sensitive device coupled between said heating element and one of said conductors for feeding of current to said heating element to control the operating temperature of said element as a function of ambient temperature; a tubular enclosure sealed against ingress of water and formed by a metal tube closed against ingress of water at one end, an electrically insulative plastics tube joined at one of its ends in water-tight manner to the other end of said metal tube, and a sealing plug through which said conductors extend and which seals the other of the ends of said plastics tube, said heating element being within said metal tube and said temperature-sensitive device being within said plastics tube; electrical insulating means electrically insulating said heating element from said metal tube; and a glass tube containing said tubular enclosure and which is closed against ingress of moisture at one end and is sealed against ingress of water at its other end by sealing means through which said conductors pass.

2. A heater according to claim 1, including heat insulating material in said tubular enclosure separating two zones, one containing said heating element and the other containing said temperature-sensitive device, that other zone being wholly within said plastics tube.

3. A heater according to claim 2, including a first insulation electrically insulating said heating element from said metal tube and a second insulation electrically insulating said heating element from the first insulation.

4. A heater according to claim 3, wherein said heating element includes a heating wire, and said first insulation is a tube of insulating material held spaced from said heating wire of said element.

5. A heater according to claim 4, wherein said second insulation is a particulate mineral insulation

6. A heater according to claim 1, wherein said metal tube and said plastics tube are telescoped together and said plastics tube has a portion with serrations engaged by said metal tube and which retain adhesive sealing said tubes together.

7. A heater according to claim 1, including a position-sensitive switch which prevents energization of said heating element when said tubular enclosure is at less than a predetermined angle to the horizontal.

* * * * *